US007942208B2

(12) United States Patent
Hughes, IV et al.

(10) Patent No.: US 7,942,208 B2
(45) Date of Patent: May 17, 2011

(54) SYSTEM AND METHOD FOR BLADE LEVEL CONTROL OF EARTHMOVING MACHINES

(75) Inventors: Edward C. Hughes, IV, Fort Wayne, IN (US); Christopher Alan Williamson, West Lafayette, IN (US); Joshua D. Zimmerman, Lafayette, IN (US); Monika Marianne Ivantysynova, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 12/613,100

(22) Filed: Nov. 5, 2009

(65) Prior Publication Data

US 2010/0163258 A1 Jul. 1, 2010

Related U.S. Application Data

(60) Provisional application No. 61/111,745, filed on Nov. 6, 2008.

(51) Int. Cl.
*E02F 3/76* (2006.01)

(52) U.S. Cl. ..... 172/4.5

(58) Field of Classification Search ..... 37/466, 37/468, 347, 348; 172/2–11, 779, 818–821; 701/50

See application file for complete search history.

(56) References Cited

U.S. PATENT DOCUMENTS

| | | | | |
|---|---|---|---|---|
| 4,934,463 | A * | 6/1990 | Ishida et al. | 172/4.5 |
| 5,329,767 | A | 7/1994 | Hewett | |
| 5,622,226 | A * | 4/1997 | Hausman et al. | 172/4.5 |
| 7,543,449 | B2 | 6/2009 | Ivantysynova et al. | |
| 7,588,088 | B2 * | 9/2009 | Zachman | 172/4.5 |
| 7,689,351 | B2 | 3/2010 | McCain | |
| 2007/0130928 | A1 | 6/2007 | Price | |

FOREIGN PATENT DOCUMENTS

| | | |
|---|---|---|
| DE | 10303360 | 8/2004 |
| EP | 0849406 | 6/1998 |
| JP | 08302730 | 11/1996 |
| WO | 2004067969 | 8/2004 |

OTHER PUBLICATIONS

Zimmerman and Ivantysynova; The Effect of System Pressure Level on the energy Consumption of Displacement Controlled Actuator Systems; Published at Conference in Krakou, Poland, Jul. 2008.

Williamson, Zimmerman, Ivantysynova; Efficiency Study of an Excavator Hydraulic System Based on Displacement-Controlled Actuators; Published at Conference in Bath, UK, Sep. 2008.

* cited by examiner

*Primary Examiner* — Robert E Pezzuto

(74) *Attorney, Agent, or Firm* — Hartman & Hartman, P.C.; Gary M. Hartman; Domenica N. S. Hartman

(57) ABSTRACT

A system for automatically controlling the position and level of an earthmoving implement on an earthmoving machine. The system includes at least one hydraulic actuator adapted to raise and lower the earthmoving implement, a device for delivering a pressurized fluid to and receiving pressurized fluid from the actuator, and an electronic control circuit that includes electronic sensors for sensing the absolute orientation of the machine and the position of the actuator, and a controller for receiving outputs of the sensors, calculating an amount of the pressurized fluid that must be delivered to or received from the actuator to achieve a desired position for the earthmoving implement, and control the delivering-receiving device to deliver or receive the amount of the pressurized fluid to achieve the desired position for the earthmoving implement.

24 Claims, 2 Drawing Sheets

SYSTEM AND METHOD FOR BLADE LEVEL CONTROL OF EARTHMOVING MACHINES

CROSS REFERENCE TO RELATED APPLICATIONS

This application claims the benefit of U.S. Provisional Application No. 61/111,745, filed Nov. 6, 2008, the contents of which are incorporated herein by reference.

BACKGROUND OF THE INVENTION

The present invention generally relates to systems for operating hydraulic circuits. In particular, this invention relates to a hydraulic system for controlling the position of a working (earthmoving) implement on an earthmoving machine, and more particularly to controlling the blade level of an earthmoving machine, for example, an excavator.

Compact excavators are an example of multi-functional earthmoving machines that often have multiple standard functions. FIG. 1 illustrates a compact excavator 100 as having a cab 101 mounted on top of an undercarriage 102 via a swing bearing (not shown) or other suitable device. The undercarriage 102 includes tracks 103 and associated drive components, such as drive sprockets, rollers, idlers, etc. The excavator 100 is further equipped with a blade 104 and an articulating mechanical arm 105 comprising a boom 106, a stick 107, and an attachment 108 represented as a bucket, though it should be understood that a variety of different attachments could be mounted to the arm 105. The functions of the excavator 100 include the motions of the boom 106, stick 107 and bucket 108, the offset of the arm 105 during excavation operations with the bucket 108, the motion of the blade 104 during grading operations, the swing motion for rotating the cab 101, and the left and right travel motions of the tracks 103 during movement of the excavator 100. In the case of a compact excavator 100 of the type represented in FIG. 1, the blade 104, boom 106, stick 107, bucket 108 and offset functions are typically powered with linear actuators 109-114, represented as hydraulic cylinders in FIG. 1.

The blade 104 of the excavator 100 and similar earthmoving machines is adapted for moving soil, for example, backfilling a hole or other types of tasks that entail controlling the blade 104 to create a level soil surface, often in spite of changes in machine orientation while driving over uneven ground. In FIG. 1, the blade position is represented as determined by the linear actuators 113 and 114, which may be double-acting, single-rod hydraulic cylinders connected to the blade 104 and the undercarriage 102 of the excavator 100, though it is foreseeable that any number and type of actuators could be used. The flow rate of pressurized oil to the actuators 113 and 114 is typically controlled with a manually-operated hydraulic valve (not shown). Alternatively, the actuators 113 and 114 can be directly controlled with a hydraulic pump (not shown). Several pump-controlled hydraulic systems are known that use constant and variable displacement pumps. If the blade hydraulic system utilizes a variable displacement pump connected to a single-rod actuator in a closed hydraulic circuit, one or more valves typically connect the circuit to a charge pump and compensate for the difference in volume between the two chambers of the actuator resulting from the presence of the rod within one of the chambers. This volumetric compensation may be achieved with a single spool-type valve (such as in U.S. Pat. No. 5,329,767), two pilot-operated check valves, or another way.

In the past, operators of earthmoving equipment have been required to exert considerable skill and attention to manually control the blade position to compensate for changes in machine orientation due to operating the machine on uneven surfaces. Because of the difficulty of this task, various methods are known for controlling the blade's cylinder position based on absolute position references via lasers or geographical positioning systems (GPS).

BRIEF DESCRIPTION OF THE INVENTION

The present invention provides a system and method for automatically controlling the blade position and level of an earthmoving machine, such as an excavator.

According to a first aspect of the invention, the system includes at least one hydraulic actuator adapted to raise and lower the earthmoving implement, a device for delivering a pressurized fluid to and receiving pressurized fluid from the actuator, and an electronic control system that includes electronic sensors for sensing the absolute orientation of the machine and the position of the actuator and a controller for receiving outputs of the sensors. The controller calculates an amount of the pressurized fluid that must be delivered to or received from the actuator to achieve a desired position for the earthmoving implement, and controls the delivering-receiving means to deliver or receive the amount of the pressurized fluid to achieve the desired position for the earthmoving implement.

According to a second aspect of the invention, the method includes delivering a pressurized fluid to and receiving pressurized fluid from least one hydraulic actuator adapted to raise and lower the earthmoving implement, and operating an electronic control system to sense the absolute orientation of the machine and the position of the actuator, calculate an amount of the pressurized fluid that must be delivered to or received from the actuator to achieve a desired position for the earthmoving implement, and then deliver to or receive from the actuator the amount of the pressurized fluid to achieve the desired position for the earthmoving implement.

Another aspect of the invention is an earthmoving machine equipped with the system described above.

In view of the above, it can be seen that a significant advantage of this invention is that the operator of the earthmoving machine can readily control the position of an implement (such as a blade) to compensate for changes in the absolute orientation (including pitch and roll) of the machine resulting from the machine traveling over uneven ground. The system can also be used to maintain the implement at a desired orientation relative to earth, in other words, horizontal or at some desired angle, regardless of the machine's absolute orientation.

Other aspects and advantages of this invention will be better appreciated from the following detailed description.

DETAILED DESCRIPTION OF THE INVENTION

Figure 1:
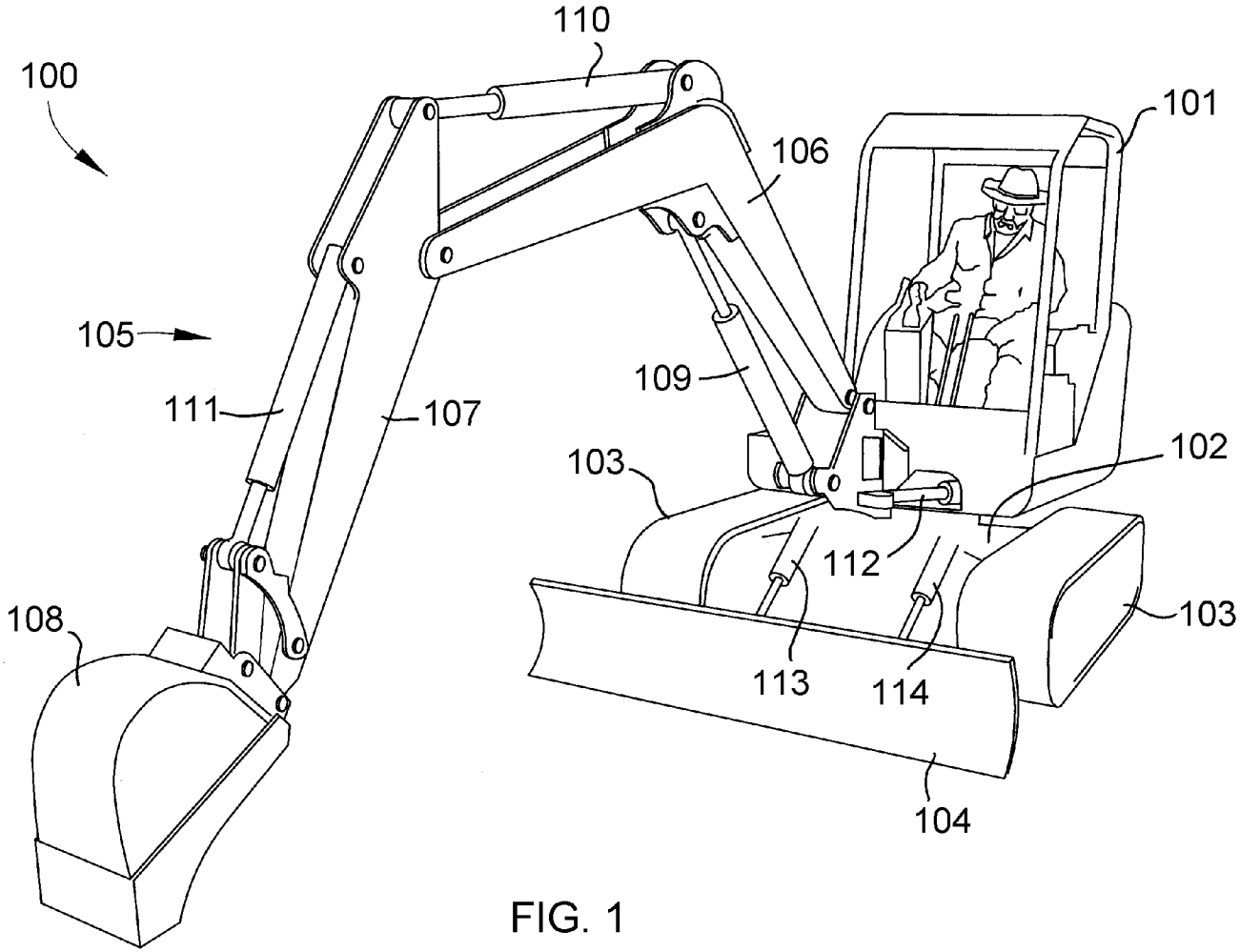
FIG. 1 schematically represents a compact excavator of a type known in the prior art.
Figure 2:
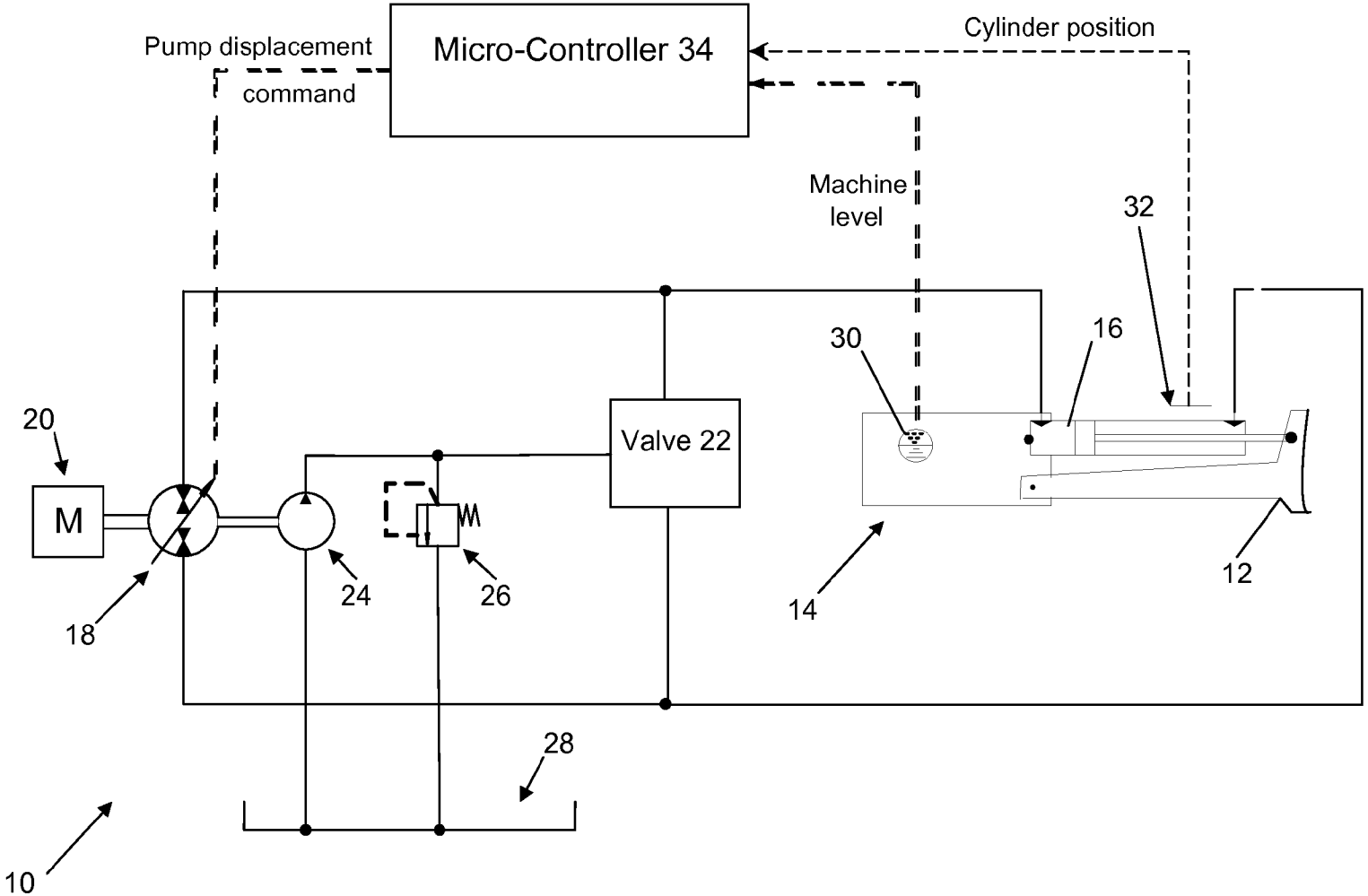
FIG. 2 represents a pump-controlled actuator circuit for automatically controlling the blade position and level of an earthmoving machine in accordance with an embodiment of this invention.

FIG. 2 schematically represents a system 10 for automatically controlling the position and level of a blade 12 of an earthmoving machine 14 relative to the machine 14 and the ground surface over which the machine 14 travels. The system 10 is represented in FIG. 2 as comprising a closed hydraulic circuit containing a pump-controlled hydraulic actuator 16 adapted to control the movement of the blade 12, including raising and lowering of the blade 12 as well as leveling of the blade 12 (or, if desired, angling/sloping of the blade 12) relative to the machine 14. The actuator 16 is preferably one of multiple actuators (not shown) connected to the blade 12, similar to the linear actuators 113 and 114 used to control the blade 104 of the excavator 100 of FIG. 1. The invention is also suited for use with other types of earthmoving machines that are commonly equipped with a blade or another earthmoving implement.

As represented in FIG. 2, the actuator 16 is represented as a double-acting, single-rod hydraulic cylinder connected to the blade 12 and to a suitable frame structure of the machine 14. The flow rate of pressurized oil or other suitable hydraulic fluid to the actuator 16 is controlled with a variable displacement pump 18, which may be powered by a primary power source 20, for example, an internal combustion engine. One or more valves 22 connect the circuit to a charge pump 24 and compensate for the difference in volume between the two chambers of the actuator 16, with excess hydraulic fluid being returned through a pressure relief valve 26 to a reservoir 28 from which the charge pump 24 draws the fluid.

The system 10 automatically adjusts the position of the blade 12 via an electronic control circuit to achieve leveling of the blade 12 relative to the ground surface (not shown) beneath the machine 14. In FIG. 2, a preferred embodiment of the invention is represented as using a first electronic sensor 30 to sense the level, more particularly the absolute orientation (roll and pitch), of the machine 14 relative to earth, and a second electronic sensor 32 to sense the linear position of the piston rod of each actuator 16. The signals of the sensors 30 and 32 are sent to a digital micro-controller 34, where a desired actuator flow rate is calculated to achieve a desired position (extension) for each actuator 16. The desired flow rate corresponds to a particular pump displacement of the pump 18, which is controlled electro-hydraulically by the micro-controller 34. The system 10 can be used to control the actuators 16 connected to the blade 12 so as to create a level soil surface in spite of changes in machine orientation while driving over uneven ground. A control panel (not shown) can be provided by which an operator can program the micro-controller 34 to maintain the blade 12 in an essentially level orientation (horizontal to earth or perpendicular to gravity), and optionally at some desired angle (slope) to horizontal.

Alternate configurations to that of FIG. 2 are also possible. For example, an angular position sensor could be attached to the actuator(s) 16 or blade joints instead of the linear position sensor 32 attached to the actuator 16. Furthermore, the invention could be implemented in a valve-controlled hydraulic circuit with an electrically-actuated hydraulic valve.

A hydraulic system 10 as described above offers the following advantages. In the prior art, the operator of the earthmoving machine 14 would be required to exert considerable skill and attention to manually control the blade position to compensate for changes in machine orientation. The present invention achieves the same result automatically through the sensors 30 and 32, micro-controller 34 and pump 18, thereby increasing the usability and productivity of the machine 14. The micro-controller 34 can also enable an operator to control the system 10 to precisely maintain a desired slope angle, which is not possible with manually operated circuits. The present invention also has the advantage of being simpler than prior art systems based on absolute position measurements (e.g., lasers and GPS), and is more appropriate to the relatively simple earthmoving task of backfilling a trench or hole. Other aspects and advantages of this invention will be appreciated from further reference to FIG. 2.

While the invention has been described in terms of a specific embodiment, it is apparent that other forms could be adopted by one skilled in the art. For example, the functions of each component of the system 10 could be performed by components of different construction but capable of a similar (though not necessarily equivalent) function. Accordingly, it should be understood that the invention is not limited to the specific embodiment illustrated in the Figures. Instead, the scope of the invention is to be limited only by the following claims.

The invention claimed is:

1. A system for automatically controlling the position and level of an earthmoving implement on an earthmoving machine, the system comprising:

at least one hydraulic actuator adapted to raise and lower the earthmoving implement;

means for delivering a pressurized fluid to and receiving pressurized fluid from the actuator; and an electronic control circuit comprising electronic sensors for sensing an absolute orientation of the machine and the position of the actuator, and a controller for receiving outputs of the sensors, calculating an amount of the pressurized fluid that must be delivered to or received from the actuator to achieve a desired position for the earthmoving implement, and controlling the delivering-receiving means to deliver or receive the amount of the pressurized fluid to achieve the desired position for the earthmoving implement.

2. The system according to claim 1, wherein the delivering-receiving means comprises a variable displacement pump.

3. The system according to claim 1, wherein the machine is an excavator.

4. The system according to claim 1, wherein the earthmoving implement is a blade.

5. The system according to claim 4, wherein the controller is operable to maintain the blade in a horizontal orientation to earth.

6. The system according to claim 1, wherein the controller is operable to maintain the blade in an orientation other than horizontal to earth.

7. The system according to claim 1, wherein the system is installed on the earthmoving machine.

8. The earthmoving machine equipped with the system of claim 7.

9. The system according to claim 1, wherein the amount of the pressurized fluid calculated by the controller is responsive to the outputs received from the sensors.

10. The system according to claim 1, wherein the at least one hydraulic actuator is a pump-controlled hydraulic actuator.

11. The system according to claim 1, wherein the desired position for the earthmoving implement is determined by a pump displacement of the delivering-receiving means.

12. The system according to claim 1, further comprising:

a closed hydraulic circuit containing the at least one hydraulic actuator and the delivering-receiving means;

a charge pump; and at least one valve connecting the charge pump to the closed hydraulic circuit and operable to compensate for a difference in volumes of chambers within the at least one hydraulic actuator.

13. The system according to claim 1, wherein the absolute orientation of the machine sensed by the electronic sensors includes roll and pitch of the machine relative to earth.

14. A method of automatically controlling the position and level of an earthmoving implement on an earthmoving machine, the method comprising:

delivering a pressurized fluid to and receiving pressurized fluid from at least one hydraulic actuator adapted to raise and lower the earthmoving implement; and operating an electronic control circuit to sense an absolute orientation of the machine and the position of the actuator, calculate an amount of the pressurized fluid that must be delivered to or received from the actuator to achieve a desired position for the earthmoving implement, and then deliver to or receive from the actuator the amount of the pressurized fluid to achieve the desired position for the earthmoving implement.

15. The method according to claim 14, wherein the earthmoving implement is a blade.

16. The method according to claim 15, wherein the electronic control circuit is operated to maintain the blade in a horizontal orientation to earth as the earthmoving machine travels over an uneven surface.

17. The method according to claim 15, wherein the electronic control circuit is operated to maintain the blade in an orientation other than horizontal to earth as the earthmoving machine travels over an uneven surface.

18. The method according to claim 14, wherein the machine is an excavator.

19. The method according to claim 14, wherein the step of calculating the amount of the pressurized fluid is responsive to the absolute orientation of the machine sensed by the electronic control circuit.

20. The method according to claim 14, wherein the step of delivering the pressurized fluid to and receiving the pressurized fluid from that at least one hydraulic actuator is performed with a variable displacement pump that controls flow rate of the pressurized fluid to the at least one hydraulic actuator.

21. The method according to claim 14, wherein the at least one hydraulic actuator is a pump-controlled hydraulic actuator.

22. The method according to claim 14, wherein the electronic control circuit controls a flow rate of the pressurized fluid to the at least one hydraulic actuator to determine the desired position for the earthmoving implement.

23. The method according to claim 14, wherein the at least one hydraulic actuator and the delivering-receiving means are contained by a closed hydraulic circuit that further contains a charge pump and at least one valve connecting the charge pump to the closed hydraulic circuit, the method further comprising operating the at least one valve to compensate for a difference in volumes of chambers within the at least one hydraulic actuator.

24. The method according to claim 14, wherein the absolute orientation of the machine sensed by the electronic control circuit includes roll and pitch of the machine relative to earth resulting from the machine traveling over uneven ground.

* * * * *